United States Patent [19]

Cornette et al.

[11] Patent Number: 4,995,456

[45] Date of Patent: Feb. 26, 1991

[54] GRAVEL PACK WELL COMPLETIONS

[75] Inventors: Holley M. Cornette, Plano; Jean M. S. Weingarten, Frisco, both of Tex.

[73] Assignee: Atlantic Richfield Company, Los Angeles, Calif.

[21] Appl. No.: 518,048

[22] Filed: May 4, 1990

[51] Int. Cl.[5] ..... E21B 43/04

[52] U.S. Cl. ..... 166/51; 166/50; 166/241; 166/242

[58] Field of Search ..... 166/278, 51, 242, 241, 166/50

[56] References Cited

U.S. PATENT DOCUMENTS

| | | | |
|---|---|---|---|
| 2,140,072 | 12/1938 | Chenault | 166/51 |
| 2,371,391 | 3/1945 | Haynes | 166/51 |
| 2,513,944 | 7/1950 | Kessler | 166/278 |
| 2,978,024 | 4/1961 | Davis . | |
| 3,216,497 | 11/1965 | Howard et al. . | |
| 3,421,586 | 1/1969 | Solum | 166/51 |
| 3,850,246 | 11/1974 | Despujols | 166/278 |
| 4,595,058 | 6/1986 | Nations | 166/292 |
| 4,662,447 | 5/1987 | Bolin | 166/278 |
| 4,770,336 | 9/1988 | Arterbury et al. | 166/241 X |
| 4,856,591 | 8/1989 | Donovan et al. | 166/278 |

OTHER PUBLICATIONS

"Introducing the First Non-Rotational, Hydraulic Set Gravel Pack Systems", Completion Services, Inc., Lafayette, LA.

"Innovative Sand Control Technology", Howard Smith Screen Co., Houston, TX.

*Primary Examiner*—Hoang C. Dang

*Attorney, Agent, or Firm*—Drude Faulconer

[57] ABSTRACT

A method and apparatus for gravel-packing a formation which is especially useful in completing long production or injection zones and zones lying in deviated or horizontal boreholes wherein a gravel-pack tool is lowered to position a perforated liner adjacent the formation thereby forming an annulus between the liner and the formation. A gravel slurry is flowed down the borehole and is directed into a spiral flowpath by a distributor, e.g. helically-shaped vanes, on the tool as the slurry enters the annulus at the top of the liner. The spiraling of the slurry around the substantially-horizontal liner aids in directing gravel into production perforations if the well is cased and overcomes some of the gravitational effects on the settling of the gravel thereby providing a more uniform and efficient gravel pack around the liner.

2 Claims, 2 Drawing Sheets

GRAVEL PACK WELL COMPLETIONS

TECHNICAL FIELD

The present invention relates to gravel pack well completions and in one of its preferred aspects relates to gravel completions which are especially useful in long production zones and production zones which lie in deviated and/or horizontal wells.

BACKGROUND ART

In producing hydrocarbons and the like from certain subterranean formations, it is now common to drill production wells at angles which are highly deviated from vertical. For example, where several wells are to be drilled from a single surface site, each well is deviated so that the bottom of the well will lie a substantial distance from the bottoms of the other wells when all of the wells are completed into the producing formation.

Further, many hydrocarbon-bearing formations may be produced more economically from a horizontal well bore due to the formation thickness, porosity, permeability, etc. As will be understood in the art, a "horizontal" well is a well which is normally formed by initially drilling the borehole from the surface in a generally vertical direction and then curving the borehole in a highly deviated or horizontal direction whereby the "bottom" of the borehole extends substantially horizontal through the production formation for a substantial distance. This substantially increases the surface area of the borehole which is in direct contact with the producing formation through which the hydrocarbons from the formation can flow into the borehole. The same holds true for wells which are to be used as injector wells in water floods, gas floods and reservoir repressurization, and the like.

Unfortunately, many of the hydrocarbon-bearing formations to be produced from deviated or horizontal wells are originally incompetent (i.e. formed of an unconsolidated matrix material such as loose sandstone or the like) or become incompetent when produced over periods of time. When producing such formations, large volumes of sand and/or other particulate material becomes entrained in the fluids and are produced therewith. This produced sand is highly detrimental to the production equipment such as the downhole pumps and surface equipment and routinely leads to high maintenance cost and substantial downtime.

One of the best known techniques for alleviating sand production involve "gravel packing" the borehole adjacent the production formation. Basically, gravel packing includes the steps of placing a fluid-permeable liner (screen, slotted pipe, etc.) within the borehole (cased or open) adjacent the production interval and then filling the annulus formed between the borehole wall and the liner with gravel or the like. When properly positioned in the annulus, the gravel supports the walls, prevents caving of loose material against the liner, and serves to restrain particulate material from the formation, e.g. sand, from flowing into the borehole with the produced fluids.

Several techniques are known for placing the gravel in the well. Probably the most commonly used of these involves mixing the gravel with a high viscosity fluid (e.g. crude oil, polymer-type, water-based fluids, and the like) to form a gravel-slurry and then circulating the slurry down the borehole. While the circulation may be either normal or reverse circulation, a typical technique flows the slurry down a tubing which supports the liner on the lower end thereof. As the slurry reaches the top of the liner, it exits the tubing through a perforated section or a "cross-over" sub and flows down the annulus around the liner. The carrier fluid from the slurry flows both into the formation and through the screened openings of the liner, the latter being returned to the surface through an annulus formed around the tubing above the liner. It is desirable that gravel be carried into and deposited in the production perforations formed in the casing (if the borehole is cased). The small openings in the liner, however, prevent the gravel from entering the liner. Accordingly, the gravel is separated from the fluid and is deposited in the annulus around the liner thereby forming the "gravel pack".

Gravel packing has achieved universal use in substantially vertical wells where gravity aids in properly distributing and settling the gravel around the liner. However, problems exist when gravel pack completions are attempted through long production zones or in highly deviated or horizontal wells. That is, when a gravel-slurry flows out of the tubing into the annulus at the "top" of a liner in a long production zone or in a deviated or horizontal well, the gravel in the slurry has a tendency due to gravity, to fall out and form a "dune" along the liner which may eventually becomes a plug thereby reducing the velocity of the gravel-slurry and its efficiency in filling the perforations (in a cased hole) and in forming a uniform pack around the liner. Also, in a horizontal wellbore, the gravel-slurry will have a tendency to flow unevenly on the bottom side of the borehole which may result in an uneven distribution of the gravel both in the casing perforations and around the horizontally positioned liner.

DISCLOSURE OF INVENTION

The present invention provides a method and apparatus for gravel-packing a long production zone or a production zone which lies in a deviated or horizontal borehole. Generally speaking, the invention involves positioning a fluid-permeable liner adjacent a production zone to form an annulus between the liner and either an open or cased borehole. A slurry of particulate material (e.g. gravel, sand, etc.) and a carrier fluid is then flowed down the borehole and directed into a spiral flowpath as it enters the annulus whereby the slurry flows around the periphery of the liner as it flows through the annulus. This spiraling flow of the slurry converts some of the energy of the slurry from axial velocity to rotational velocity which, in turn, offsets some of the gravitational settling of the gravel thereby providing a more uniform flow around and along the liner. Also, in cased holes, the spiral or rotational flow will help in directing gravel into the production perforations which are formed in the casing to fill the perforations to thereby increase the overall efficiency of the final gravel pack in preventing the production of particulate material from the formation.

More specifically, a gravel-pack tool in accordance with the present invention is lowered into a well to position a fluid-permeable liner adjacent a desired production zone or formation within the well thereby forming an annulus between the wellbore and the liner. The gravel-pack tool is comprised of a completion assembly and a setting tool and cross-over sub assembly. The completion assembly is comprised of a body having a perforated extension to which is connected a fluid-permeable liner (e.g. screened, perforated pipe or the like). The body includes a packer thereon for preventing upward flow around the body when the completion assembly is in an operable position within the borehole.

The completion assembly is releasably coupled to the setting tool and cross-over sub assembly which, in turn, is carried by the lower end of a conduit, e.g. production tubing, drill pipe, etc., on which the gravel-pack tool is run into place. The cross-over sub has (a) a first passage for providing fluid communication from the conduit, through the perforated extension on the completion assembly, to a point in the annulus around the liner below the packer and (b) a second passage for providing fluid communication between the interior of the liner and a point outside the sub above the packer.

One or more distributors, e.g. a plurality of helically-shaped vanes, are positioned on the outside surface of the completion assembly below said first passage in said sub whereby any fluids (e.g. gravel-carrier fluid slurry) exiting from the first passage will be directed into a spiral flowpath as they enter the annulus at the top of the liner. This causes the slurry to flow around the periphery of the liner as it flows through the annulus to provide a better and more even distribution of the gravel as it separates from the carrier fluid and settles around the liner in the annulus. Also, in cased holes, the spiral flow of the slurry aids in directing or forcing gravel into the perforations present in the casing to fill the perforations with gravel thereby increasing the efficiency of the final gravel pack.

As will be understood, some of the carrier fluid flows into the formation with the rest of the fluid flowing into the liner. Fluid entering the liner flows through the second passage in the sub to be returned to the surface through an annulus formed between the well conduit and the borehole above the packer.

The distributor described above may be comprised of short or long helically-shaped vanes and further may be comprised of a plurality of individual units which are spaced along the body and/or the liner or may be only one continuous set of helically-shaped vanes which may extend along both the body and liner. The important function of the distributor(s) is to impart spiral or rotational flow to the slurry as it enters the annulus at the top of the liner.

BRIEF DESCRIPTION OF THE DRAWINGS

The actual construction, operation, and apparent advantages of the present invention will be better understood by referring to the drawings in which like numerals identify like parts and in which.

BEST MODE FOR CARRYING OUT THE INVENTION

Figure 1:
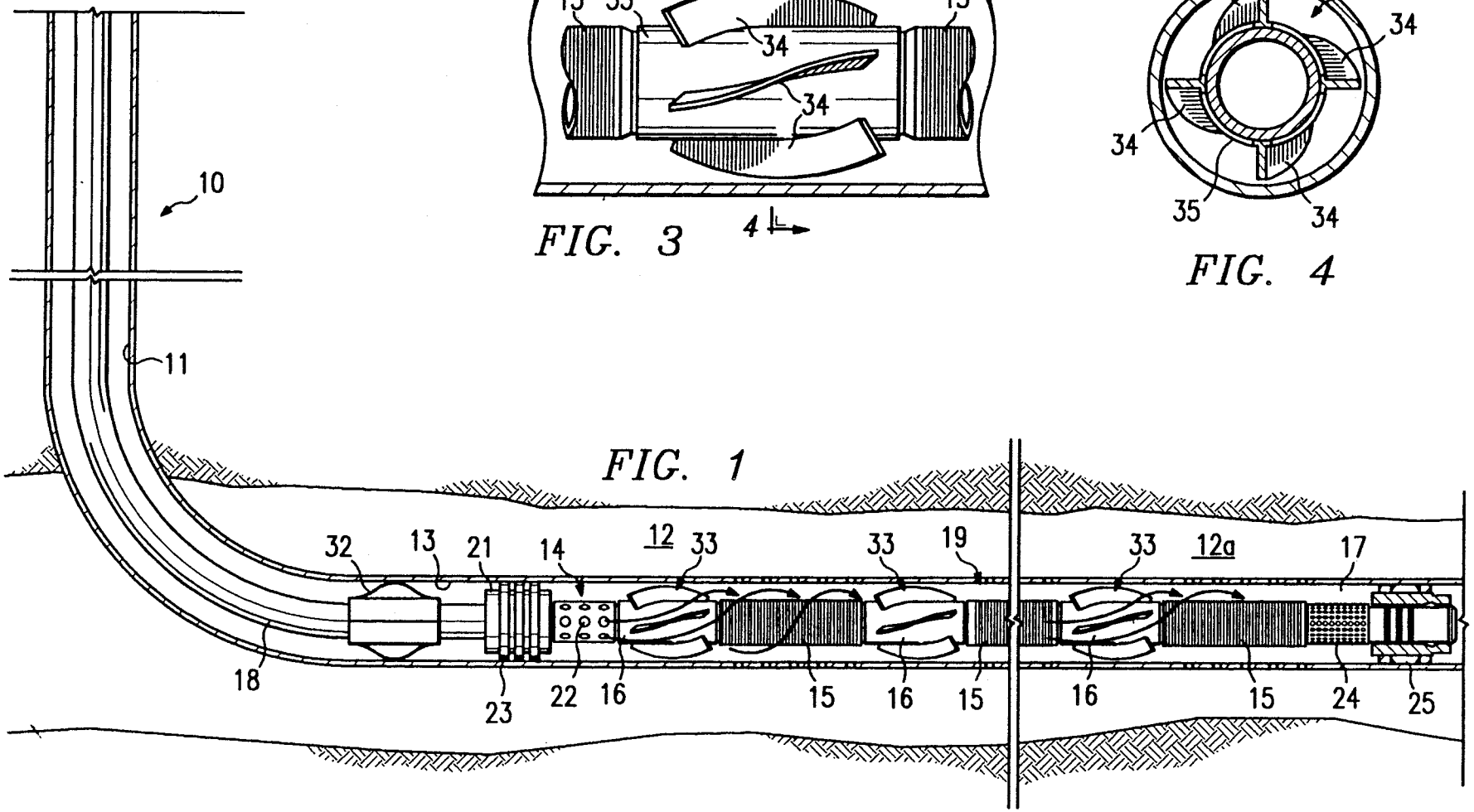
FIG. 1 is a sectional view of a horizontal borehole being gravel packed in accordance with the present invention.

Referring more particularly to the drawings, FIG. 1 is representative of a horizontal well 10 which has been drilled into a relatively incompetent production formation 12 of the type which is likely to produce sand and/or other particulate material with the formation fluids, e.g. hydrocarbons, at some time during its production life. As shown, borehole 11 has been cased along its length in accordance with routine completion techniques and casing 13 has been perforated adjacent a production zone 12*a* to establish flowpaths into casing 13. Gravel pack tool 14 having a fluid-permeable liner 15 thereon is run into borehole 11 which when positioned adjacent production zone 12*a* forms an annulus 17 between the liner and casing 13. As used herein, "fluid-permeable liner" is meant to include any and all types of liners (e.g. screens, slotted pipes, screened pipes, pre-packed liners, etc.) which are used in known well completions. The liner may be of one continuous length or may be comprised of a plurality of segments 15, joined by subs 16, as shown in the figures. While the present invention is shown as completing a zone in a horizontal well, it should be understood that the present invention can also be used for completing long zones in vertical wells or in deviated wells other than horizontal.

Gravel pack tool 14 is carried by well conduit 18 (e.g. tubing, drill pipe, or the like) and may be of basically the same structure as any of many different assemblies which are commercially available in the industry for carrying out routine gravel pack operations. For example, as illustrated, tool 14 (shown in its lower circulation position) is similar to a known gravel-pack tool available from Completion Services, Inc., Lafayette, La., and used to carry out commercial gravel pack well completions.

More specifically, gravel-pack tool 14 is comprised of a completion assembly 19 and a setting tool and cross-over sub assembly 20. Completion assembly is comprised of a body 21 having a perforated extension 22 which, in turn, is connected to the upper end of liner 15. A packer 23 is mounted on body 21 which engages casing 13 to prevent upward flow of fluid around body 21 when tool 14 is in an operable position. A perforated "tell tale" 24 is connected to the lower end of liner 15 and is landed in sump packer 25 which, in turn, is set in casing 13.

Setting tool and cross-over sub assembly 20 is connected onto the lower end of conduit 18 and is releasably coupled into body 21 of completion assembly 19. Cross-over sub 20 has a first passage 26 which provides for fluid communication from conduit 18, through perforated extension 22, into annulus 17 at a point below packer 23. A second passage 27 provides fluid communication between the interior of wash pipe 28 which is carried by cross-over sub 20 and the annulus 29 which, in turn, is formed between conduit 18 and casing 13 above packer 23. Check valves 30, 31 are provided in body 21 to control flow through tool 14. Also, one or more centralizers 32 (only one shown) may be positioned on conduit 18 to center the tool in casing 13 as will be understood in the art.

Figure 2:
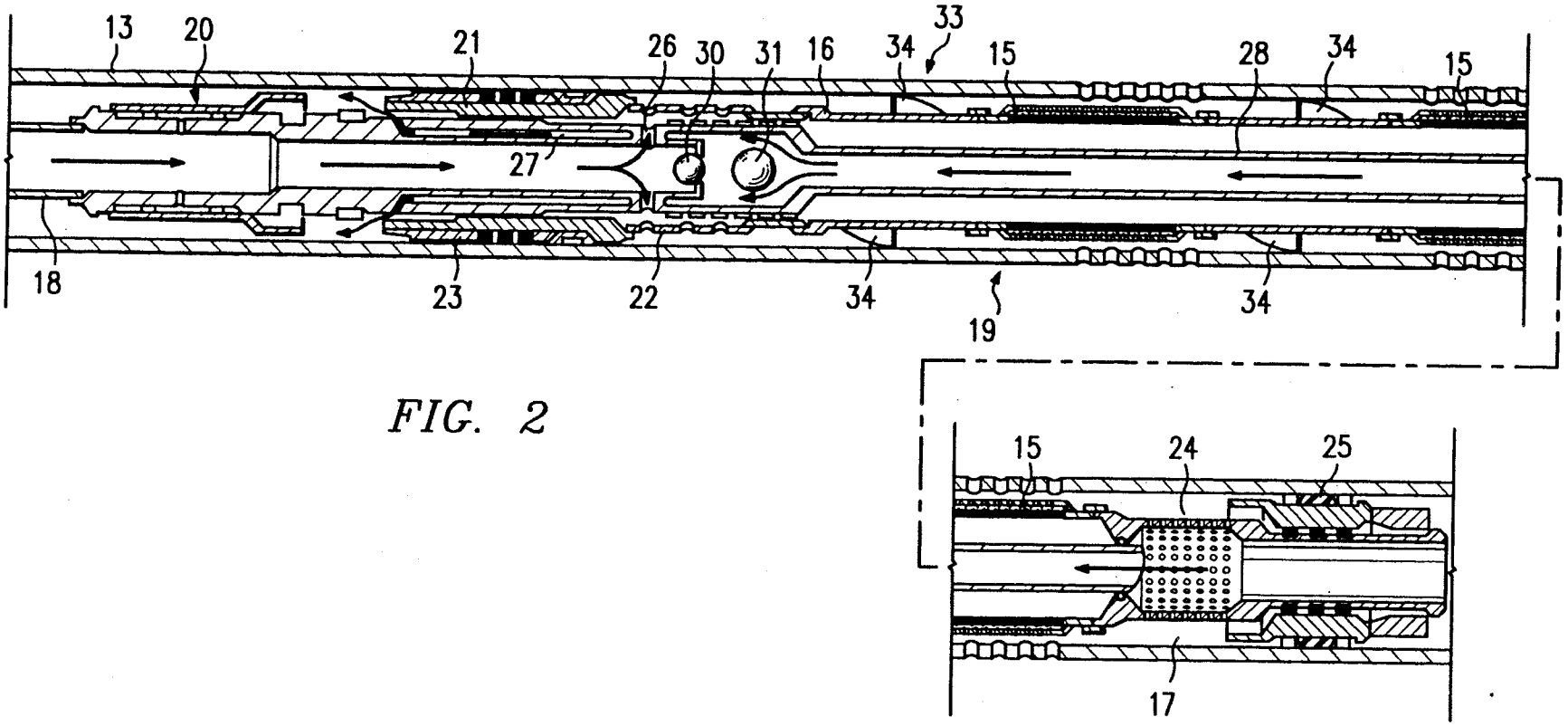
FIG. 2 is a sectional view of the gravel pack tool of FIG. 1 but enlarged and in section.

The structure as described up to this point is known and is used to carry out routine gravel pack operations. In carrying out such operations, a particulate material (e.g. gravel, sand, or the like: collectively referred herein as "gravel") is mixed with a carrier fluid ( e.g. crude oil, polymer-type, water-based liquid) and is pumped down conduit 18 to cross-over sub 20 where it flows out passage 26 and through perforated extension 22 into annulus 17. Some of the carrier fluid from the slurry will flow through the perforations in casing 13 and will carry the gravel with it. The rest of the carrier fluid will flow through the small openings (e.g. slots, screen openings, etc.) in tell tale 24 and into wash pipe 28. Due to their respective sizes, the gravel can not pass through the openings in tell tale 24 so the gravel will be "strained" and separated from the fluid and will settle to fill the annulus 17 around the liner 15. The carrier fluid flows up wash pipe 28 and out passage 27 to be returned to the surface through annulus 29. Setting tool and cross-over assembly 20 is then released from completion assembly 19 and is removed from the hole by raising conduit 18. A string of production tubing (not shown) is the lowered and fluidly connected to completion assembly 19 and formation fluids are produced through the liner and up the production tubing as will be understood in the art.

Where the borehole is substantially vertical and the production interval is relatively short, gravity will aid in providing a good distribution of the gravel around the liner as it is separated from the carrier fluid. However, where the liner is to be set through a long production zone or in a zone lying in a substantially horizontal position as it will be the case when in a highly deviated or horizontal well such as shown in FIGS. 1 and 2, this same gravity causes the gravel to fall out of the slurry before it is properly placed to form a "dune" in the annulus which may eventually plug the annulus thereby substantially reducing the flow velocity of the slurry and it efficiency in filling the production perforations in the casing and in providing a uniform pack around the liner.

Figure 4:
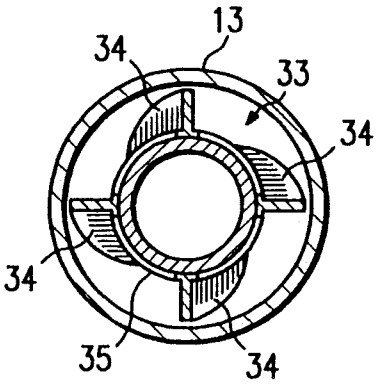
FIG. 4 is a sectional view taken along line 4—4 of FIG. 3.
Figure 3:
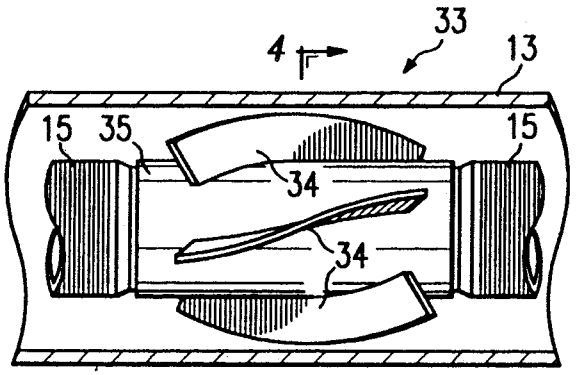
FIG. 3 is a perspective view of the gravel distributor of the present invention.

According to the present invention, a distributor 33 is affixed onto the outer surface of completion assembly 19 below the point which the gravel-carrier fluid slurry exits into annulus 17 through passage 26 and perforated section 22. Distributor 33, as illustrated, is comprised of a plurality of helically-shaped vanes 34 (four shown) which are spaced around the outer circumference of completion assembly 19. The length and number of the vanes can vary depending on the particular circumstances involved. Vanes 34 can be mounted directly on completion assembly 19 by welding or the like or they can be first mounted or formed on a collar 35 (FIG. 3) which, in turn, is mounted onto completion assembly 19 by screws, welding, or the like. Also, more than one distributor 33 can be longitudinally spaced on completion assembly 19 between perforated extension 22 and tell tale 24. As shown in FIGS. 1 and 2, distributors 33 are mounted on each of the subs 16 which connect segments 15 of the liner but it should be understood that distributors 33 could also be mounted on the liner segments, themselves.

Vanes 34 are mounted at an angle to the longitudinal axis of tool 14 and span from the tool to almost the inside of the cased borehole 11, providing just enough clearance to run the tool into position within the borehole. Due to this construction, distributors 33 also act as centralizers to keep the completion tool centered in casing 13. Vanes 34, being helical in shape, impel or impart a rotational or spiral flow to the gravel-carrier fluid slurry (see heavy arrows in the FIGS.) as the slurry flows through distributor 33. This spiral or rotational flow causes the slurry to follow a spiral or helical flow path around liner 15 as the slurry flows longitudinally along the liner and through annulus 17.

The spiral or helical flow of the slurry imparts a rotational velocity to the gravel contained in the slurry thereby converting some of the axial energy of the flowing slurry to rotational energy. This rotation of the slurry offsets some of the gravitational settling of the gravel, thereby providing for a more uniform pack around the liner, especially in deviated and horizontal wells. Also, this rotational velocity of the slurry aids in directing or forcing the slurry into the production perforations in casing 13 thereby carrying gravel into the perforations to fill same and increase the overall efficiency of the final gravel-pack.

Once sufficient gravel has been placed around the liner 15, flow is stopped and conduit 18 along with setting tool and cross-over sub assembly 20 is removed and replaced with a production tubing in the same manner as described above in relation to prior art gravel pack completions.

While the present invention has been described in connection with a standard type of gravel pack completion in a cased hole, it should be recognized that it will apply equally to other "pack" type completions, e.g. squeeze pack, frac pack, etc., be the completions in production wells or injection wells. Further, the present invention can be used in open holes as well as cased holes, and applies to reverse circulation operation as well as normal circulation operations.

What is claimed is:

1. A gravel-pack completion assembly comprising:
a body adapted to be connected at one end to the lower end of a well conduit;
a fluid-permeable liner connected to the other end of said body; and
a distributor means on said completion assembly for imparting spiral flow to any fluid flowing past said completion assembly when said completion assembly is in an operable position wherein said distributor means comprises:
a plurality of distributors longitudinally-spaced along said completion assembly; and wherein each of said plurality of distributors comprises:
a plurality of helically-shaped vanes affixed on said completion assembly.

2. A gravel-pack completion assembly comprising:
a body adapted to be connected at one end to the lower end of a well conduit;
a fluid-permeable liner connected to the other end of said body; and
a distributor means on said completion assembly for imparting spiral flow to any fluid flowing past said completion assembly when said completion assembly is in an operable position; wherein said perforated liner comprises:
a plurality of segments connected together by subs; and
wherein said distributor means comprises:
a plurality of helically-shaped vanes mounted on each of said subs.

* * * * *